US005834852A

United States Patent [19]

Katoh et al.

[11] Patent Number: 5,834,852

[45] Date of Patent: Nov. 10, 1998

[54] STARTER HAVING LESS IMBALANCE IN ARMATURE SHAFT ROTATION

[75] Inventors: Masahiro Katoh, Chiryu; Tsutomu Shiga, Nukata-gun, both of Japan

[73] Assignee: Denso Corporation, Kariya, Japan

[21] Appl. No.: 787,856

[22] Filed: Jan. 23, 1997

[30] Foreign Application Priority Data

Jan. 26, 1996 [JP] Japan ..... 8-011462

[51] Int. Cl.[6] ..... F02N 11/00

[52] U.S. Cl. ..... 290/38 R; 290/48

[58] Field of Search ..... 290/38 R, 38 A, 290/38 B, 38 C, 48; 74/6, 7 A, 7 E, 7 R; 310/78

[56] References Cited

U.S. PATENT DOCUMENTS

| | | | |
|---|---|---|---|
| 3,906,264 | 9/1975 | Kumako et al. | 310/51 |
| 4,406,963 | 9/1983 | Wolf et al. . | |
| 4,492,890 | 1/1985 | MacDonald | 310/184 |
| 4,665,320 | 5/1987 | DeBello | 290/48 |
| 5,129,271 | 7/1992 | Isozumi et al. | 74/7 R |
| 5,231,307 | 7/1993 | Yumiyama et al. | 290/48 |
| 5,508,566 | 4/1996 | Nagao et al. . | |

*Primary Examiner*—Steven L. Stephan
*Assistant Examiner*—Judson H. Jones
*Attorney, Agent, or Firm*—Cushman Darby & Cushman IP Group of Pillsbury Madison & Sutro LLP

[57] ABSTRACT

In an armature in which upper coil end arms extend toward an armature shaft substantially perpendicular to the armature shaft, at least one of first and second bearings supporting the armature shaft uses a ball bearing. The inner ring of the ball bearing is fixed to the armature shaft and the outer ring of the ball bearing is fixed to a cylindrical part of a holding plate such as of a brush holding member. The armature is pressed in the axial direction by brush springs so that, even if the armature tends to move in the axial direction due to armature imbalance when it rotates at high speeds, it is prevented from such an axial movement and is kept centered by the axial pressing action of the brush springs combined with a thrust bearing action of the ball bearing.

11 Claims, 3 Drawing Sheets

STARTER HAVING LESS IMBALANCE IN ARMATURE SHAFT ROTATION

BACKGROUND OF THE INVENTION

1. Field of the Invention

This invention relates to a starter for starting an engine and more particularly to a starter which has less imbalance in armature shaft rotation.

2. Description of Related Art

A conventional starter, for example as shown in Australian Unexamined Patent Publication No. AU-A-80486/94 (which corresponds to U.S. Pat. No. 5,508,566), has an armature wherein upper and lower coil bars are fitted in each slot of an armature core mounted on an armature shaft. The ends of the lower coil bar are connected to a pair of lower coil end arms each extending substantially perpendicularly with respect to the armature shaft, and the ends of the upper coil bar are connected to a pair of upper coil end arms each extending substantially perpendicularly with respect to the armature shaft. The other ends of the upper coil end arms and the lower coil end arms are connected together thereby to form an armature coil. In this armature, the upper coil end arms at one axial side of the armature are used as commutator segments so that brushes are disposed on the upper coil end arms. The brushes are pressed by brush springs against the upper coil end arms, i.e. in an axial direction.

One end of the armature shaft is supported by a first metal bearing mounted in the rear end of a planet carrier of an output shaft, the other end is supported by a second metal bearing mounted in a brush holder, and a sun gear meshing with planetary gears of a planetary gear mechanism is disposed between the armature core and the part of the armature shaft supported by the first bearing. The planet carrier is formed integrally with the output shaft, and a pinion which meshes with a ring gear of an engine flywheel is mounted on the output shaft.

However, in the conventional starter described above, due to the influence of the armature rotation, although small there need radial clearances between the armature shaft and the first and second bearings. When the armature rotates at high speed, due to imbalance of the armature, radial vibration is caused within the range of these small clearances. Consequently, the armature tends to generate a beating sound. Further, the radial vibration disables stable sliding contact of parts with the brushes, deteriorating commutation performance. In addition, there arises a possibility of the contact resistance increasing and it not being possible to maintain output performance.

Also, when the pinion meshes with the ring gear of the engine to drive the engine, vibration from rotational pulsation of the engine is readily transmitted to the armature through the pinion, the output shaft and the bearing mounted in the rear end of the planet carrier of the output shaft, and the armature vibration caused by imbalance of the armature described above when the armature rotates at high speed is worsened.

SUMMARY OF THE INVENTION

It is therefore an object of the invention to provide a starter wherein vibration caused by armature imbalance at high rotation speeds is limited and consequent beating noise production, commutation deterioration and performance reduction are suppressed.

According to the present invention, in a starter constructed by an armature having an armature shaft, an armature core and a commutator fixed to the armature shaft, first and second bearings support opposite ends of the armature shaft. First and second holding members hold the first and second bearings, and a pressing member presses the armature in an axial direction. At least one of the first and second bearings is a rolling bearing such as a ball bearing or a roller bearing for supporting a radial load and a thrust load. An inner ring of the rolling bearing is fixed to the armature shaft and an outer ring of the rolling bearing is fixed to one of the first and second holding members. The armature is pressed in the axial direction by the pressing member.

With this construction, when the armature rotates at high speed, even if due to armature imbalance it tends to vibrate, an axial direction load acting between a roller groove in the inner side of the outer ring and a roller groove in the outer side of the inner ring and roller elements therebetween eliminates radial clearance and limits radial vibration of the armature. This simplifies centering work for the rotating shaft. The brushes in sliding contact with the commutator make sliding contact stably and commutation deterioration is therefore suppressed, and it is possible to provide a starter which is small and light-weight and can operate at high rotation speeds. Also, by using the rolling bearing, it is possible to bear thrust loads of the armature.

Preferably, the commutator is made as a surface type commutator which enables use of brush springs to perform both the function of applying a pressing load to the brushes and the function of applying an axial direction pressing load to the armature.

Preferably, a first bearing is disposed at one end of the armature core at the other ends of the upper coil end arms and a second bearing is disposed at the other end of the armature core at the other ends of the upper coil end arms. With this construction, the first bearing and the second bearing can be brought close to the armature core end faces and the distance between the first bearing and the second bearing can be made small. Consequently even if the armature rotates at high speed, the influence of imbalance of the armature is small. Further, with the brushes making stable sliding contact with the commutator, it is possible to suppress commutation performance deterioration.

Preferably, the first bearing is disposed between the gear forming a part of a speed reduction mechanism and the armature core. With this construction, when the starter drives the engine, vibration from rotational pulsation of the engine is not transmitted by way of the output shaft to the armature shaft, and therefore such vibration does not worsen vibration caused by armature imbalance and does not cause commutation deterioration either.

Preferably, the first holding member is a holding plate formed integrally with a yoke having field poles on its inner periphery. With this construction, the first bearing can be positioned in the vicinity of the armature core and the effective rigidity of the armature rises and its resistance to vibration increases.

Preferably, the second holding means is a holding plate of a brush holder for holding brushes making sliding contact with the commutator of the armature. With this construction, the second bearing can be brought to the vicinity of the commutator and the distance between the bearings can be reduced further. Also, with the positional relationship between the brushes and the second bearing being determined by a single part, the sliding contact stability of the commutator surface and the brushes during commutation increases further.

Preferably, the armature shaft has an armature core mounting part and first and second held parts held by the first and second bearings, and the external diameters of the armature core mounting part and the first and second held parts are substantially the same. With this construction, because the rigidity of the held parts increases, when the armature rotates at high speeds, the armature shaft does not bend due to armature imbalance and its resistance to vibration increases.

Preferably, an axial center position between the axial direction center of the first bearing and the axial direction center of the second bearing and the position of the center of gravity of the armature is made substantially the same. Thus, armature imbalance is further reduced and the starter becomes suited to high speed operation.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PRESENTLY PREFERRED EMBODIMENTS

Figure 1:
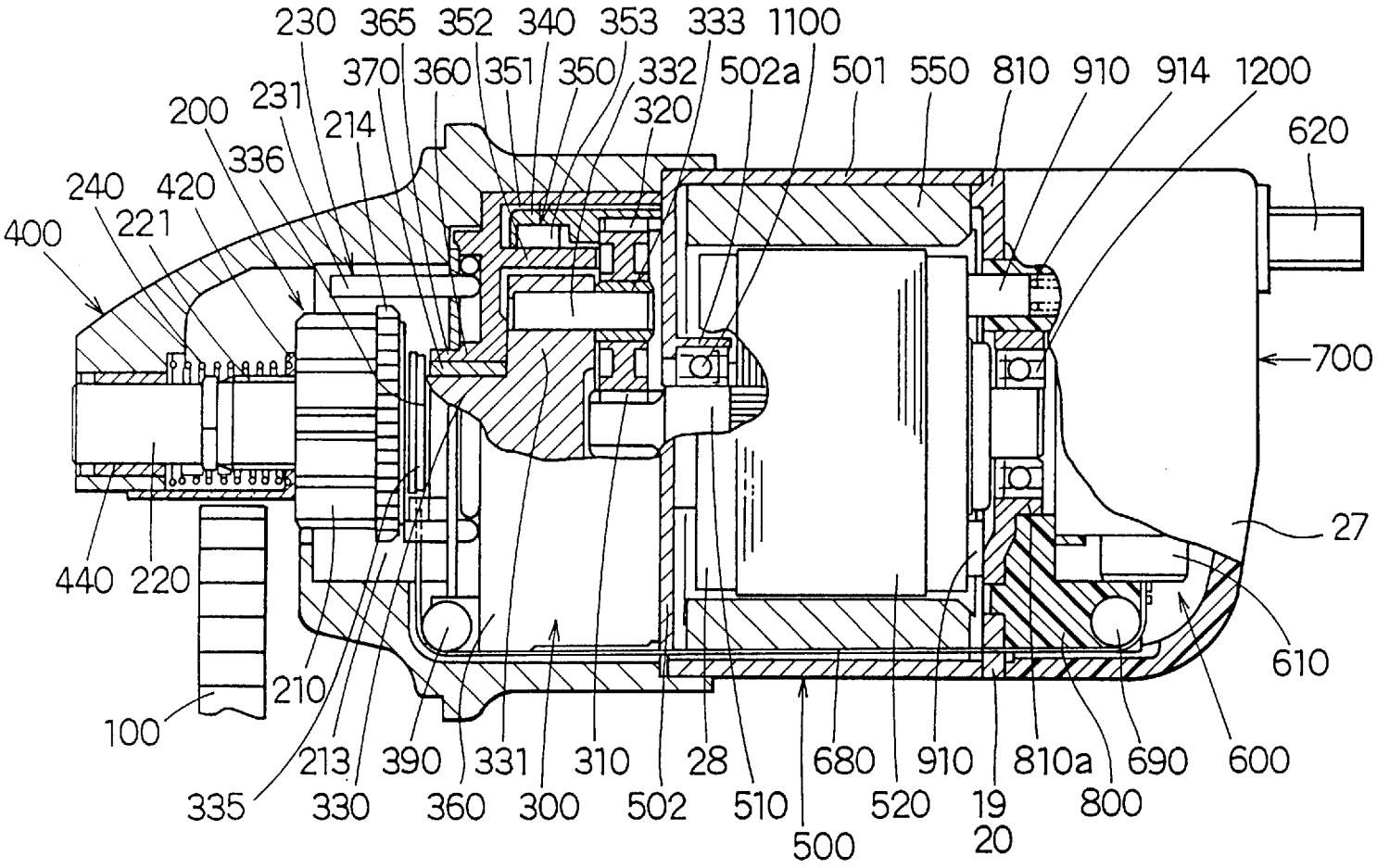
FIG. 1 is a side sectional view of a starter of a preferred embodiment of the invention.

As shown in FIG. 1, a starter of the preferred embodiment can be generally divided into a housing 400, which houses a planetary gear mechanism 300 and a pinion 200 which meshes with a ring gear 100 formed on an outer periphery of an engine flywheel, a motor 500, and an end frame 700 housing a magnet switch 600. Inside the starter, the housing 400 and the motor 500 are partitioned by a holding plate 502 and the motor 500 and the end frame 700 are partitioned by a holding plate 810.

A pinion gear 210 which meshes with the ring gear 100 of the engine is formed on the pinion 200. A pinion helical spline (not shown) mating with a helical spline 221 formed on an output shaft 220 is formed on the inner circumferential surface of the pinion gear 210.

A flange 213 of larger diameter than the external diameter of the pinion gear 210 is formed on the axially opposite side of the pinion gear 210 from the ring gear 100. A greater number of teeth or corrugations 214 than the number of teeth of the pinion gear 210 are formed around the entire circumference of the flange 213. These corrugations 214 are for a restraining claw 231 of a pinion rotation restraining member 230 to mate with.

The pinion gear 210 is urged axially rearward along the output shaft 220 normally by a return spring 240 in the form of a compression coil spring. In this preferred embodiment, the return spring 240 does not directly urge the pinion gear 210 but rather urges the pinion gear 210 by way of a shutter 420 for opening and closing an opening in the housing 400.

The planetary gear mechanism 300 is a speed reduction mechanism for reducing the speed of the motor 500, which will be further discussed later, and increasing the output torque of the motor 500. The planetary gear mechanism 300 is made up of a sun gear 310 formed on the outer periphery of the axial front end of an armature shaft 510 of the motor 500, a plurality of planetary gears 320 which mesh with and revolve around the sun gear 310, a planet carrier 330 supporting the planetary gears 320 revolvably around the sun gear 310 and formed integrally with the output shaft 220, and an internal gear 340 meshing with the planetary gears 320 on the outer side thereof and made of resin.

An overrunning clutch 350 supports the internal gear 340 rotatably in only one direction (only the direction in which it is rotated by rotation of the engine).

The overrunning clutch 350 has an annular clutch outer member 351 forming a first cylindrical part formed integrally with the front side of the internal gear 340, an annular clutch inner member 352 forming a second cylindrical part disposed facing the inner periphery of the clutch outer member 351 and formed on the rear side of a center bracket 360 forming a fixed side covering the front of the planetary gear mechanism 300, and rollers 353 accommodated in roller receiving parts (not shown) formed inclined in the inner circumferential surface of the clutch outer member 351.

The center bracket 360 is disposed inside the rear side of the housing 400. The housing 400 and the center bracket 360 are connected by way of an elastic body made of rubber or the like (not shown) so that rotational reactions acting on the clutch inner member 352 of the overrunning clutch 350 are absorbed by this elastic body and the reactions are not directly transmitted to the housing 400.

The planet carrier 330 has at its rear end a flange-shaped projecting part 331 extending in the radial direction for supporting the planetary gears 320. Pins 332 extending rearward are fixed to this flange-shaped projecting part 331, and the planetary gears 320 are rotatably supported on the corresponding pins 332 by way of metal bearings 333.

The planet carrier 330 has its front end rotatably supported by a housing bearing 440 fixed to the front end of the housing 400 and a center bracket bearing 370 fixed to an inner cylindrical part 365 of the inner periphery of the center bracket 360. The planet carrier 330 has an annular groove (not shown) in a position in front of the inner cylindrical part 365, and a stopping ring 335 is fitted in this annular groove. A washer 336 is fitted to the planet carrier 330 rotatably with respect thereto, and by the stopping ring 335 abutting with the front end of the inner cylindrical part 365 by way of the washer 336, the planet carrier 330 is prevented from moving rearward. Also, by the flange-shaped projecting part 331 abutting with the rear end of the inner cylindrical part 365 by way of the center bracket bearing 370, the planet carrier 330 is prevented from moving forward.

The motor 500 is enclosed by a yoke 501, the holding plate 502 (the first holding member) provided integrally with the yoke 501, and a holding plate 810 (the second holding member) of a brush holding member 800. The holding plate 502 is on the axially opposite side of the planetary gear mechanism 300 from the center bracket 360 and also has the function of preventing lubricating oil inside the planetary gear mechanism 300 from entering the motor 500.

Figure 2:
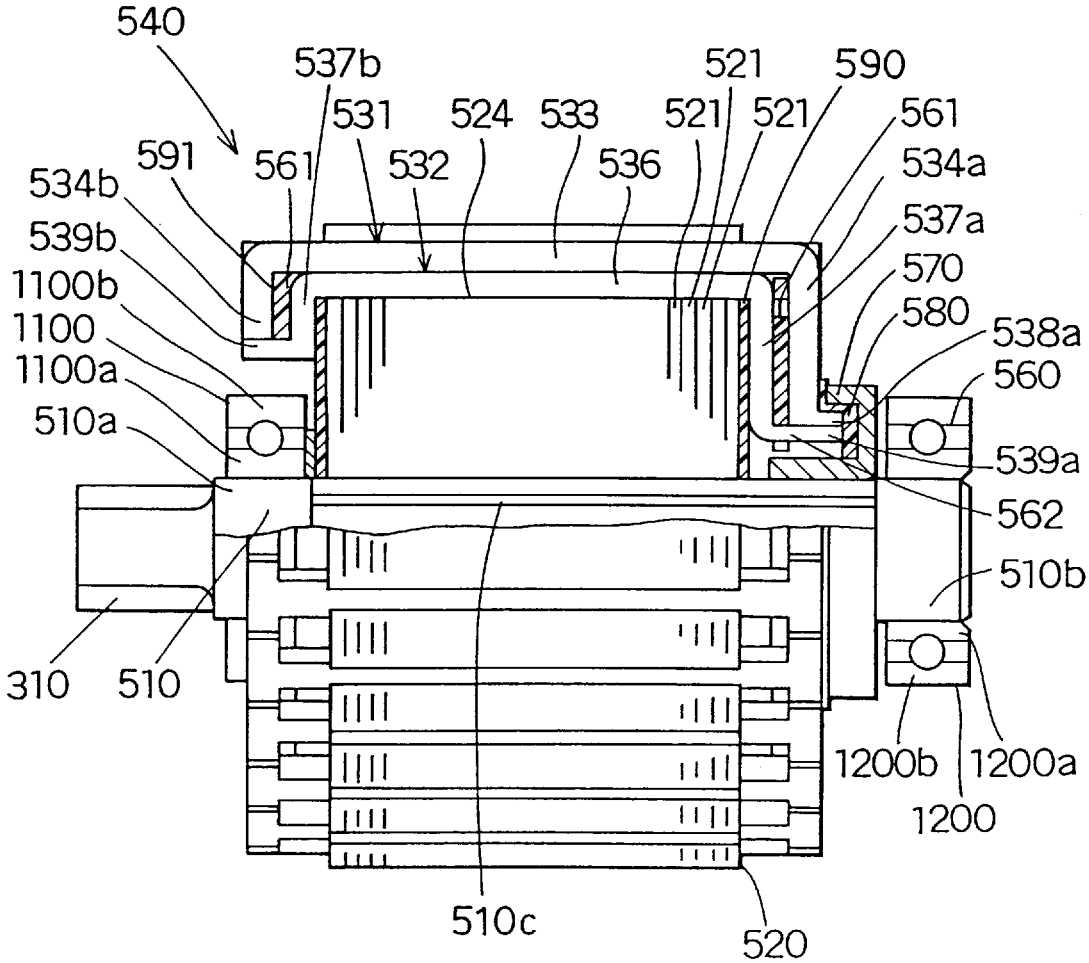
FIG. 2 is a side sectional view of an armature of the starter shown in FIG. 1.

As shown in FIG. 2 as well as in FIG. 1, the motor 500 is made up of the armature shaft 510 and the armature 540 fixed to the armature shaft 510 for rotation therewith. The armature 540 is made up of the armature core 520 and armature coils, and fixed poles 550 for rotating the armature 540, and the fixed poles 550 are fixed to the inner periphery of the yoke 501.

A first held part 510*a* and a second held part 510*b* are provided at axially opposite ends of the armature shaft 510, and the first held part 510*a* and the second held part 510*b* are respectively supported by a first bearing 1100 and a second bearing 1200, which are both ball bearings. The inner rings

1110*a*, 1210*a* of these two ball bearings 1100, 1200 are fixed by press-fitting in the first held part 510*a* and the second held part 510*b*, and the outer ring 1100*b* of the ball bearing constituting the first bearing 1100 is fixed by press-fitting in a cylindrical part 502*a* of the holding plate 502.

The outer ring 1200*b* of the ball bearing constituting the second bearing 1200 is fitted in a cylindrical part 810*a* of the holding plate 810 of the brush holding member 800.

The ball bearing constituting the first bearing 1100 is disposed in the vicinity of or immediately adjacently to the axial side of armature core 520, and the ball bearing constituting the second bearing 1200 is disposed in the vicinity of or immediately adjacently to first upper coil end arms 534*a*.

An armature core mounting portion 510*c* on which the armature core 520 is mounted by press-fitting is provided between the first held part 510*a* and the second held part 510*b*.

The sun gear 310 meshing the planetary gears 320 of the planetary gear mechanism 300 is disposed axially nearer to the end of the armature shaft 510 than the first held part 510*a* is. The external diameters of the first held part 510*a*, the second held part 510*b* and the armature core mounting portion 510*c* are all substantially the same.

In this preferred embodiment, the outer ring 1100*b* of the ball bearing that is the first bearing 1100 is fixed in the axially extending cylindrical part 502*a* of the holding plate 502 by press-fitting, while the outer ring 1200*b* of the ball bearing constituting the second bearing 1200 may be fixed in the axially extending cylindrical part 810*a* of the holding plate 810 of the brush holding member 800 by press-fitting.

For the armature coils, multiple (for example 25) upper coils 531 and the same number of lower coils 532 are used and two-layer winding coils made by stacking the upper coils 531 on the lower coils 532 in the radial direction are employed. Respective upper coils 531 and lower coils 532 are combined and end arms of the upper coils 531 and end arms of the lower coils 532 are electrically connected to form annular coils.

The upper coils 531 are made of a material having excellent electrical conductivity (for example copper) and each has an upper coil bar 533 extending in parallel with the fixed poles 550 and held in the outer side of a slot 524 and a first upper coil end arm 534*a* and a second upper coil end arm 534*b* bent inward from the axial ends of the upper coil bar 533 and each extending in a direction substantially perpendicular with respect to the axial direction of the armature shaft 510. The upper coil bar 533, the first upper coil end arm 534*a* and the second upper coil end arm 534*b* may be formed integrally by cold forging or may be formed by bending a straight bar into a U-shape with a press or may be formed by joining together by welding or the like an upper coil bar 533 and a first upper coil end arm 534*a* and a second upper coil end arm 534*b* formed as separate parts.

The lower coil bars 532 are made of a material having excellent electrical conductivity (for example copper) like the upper coil bars 531 and each have a lower coil bar 536 extending in parallel with the fixed poles 550 and held in the inner side of a slot 524 and a first lower coil end arm 537*a* and a second lower coil end arm 537*b* bent inward from the axial ends of the lower coil bar 536 and extending in a direction substantially perpendicular with respect to the axial direction of the armature shaft 510.

The lower coil bar 536, the first lower coil end arm 537*a* and the second lower coil end arm 537*b*, like the upper coil bars 531, may be formed integrally by cold forging or may be formed by bending a straight bar into a U-shape with a press or may be formed by joining together by welding or the like a lower coil bar 536, a first lower coil end arm 537*a* and a second lower coil end arm 537*b* formed as separate parts.

Insulation between the first upper coil end arm 534*a* and the first lower coil end arm 537*a* is provided by an insulating spacer 561, and insulation between the second upper coil end arm 534*b* and the second lower coil end arm 537*b* is provided similarly.

Insulation between the first lower coil end arm 537*a* and the armature core 520 is provided by an insulating ring 590 made of resin (for example nylon or phenol resin), and insulation between the second lower coil end arm 537*b* and the armature core 520 is provided similarly.

Each upper coil 531 has a first upper inner extension part 538*a* extending in the axial direction from the inner end of the first upper coil end arm 534*a*. The inner peripheral surface of this first upper inner extension part 538*a* is positioned on the outer periphery of a first lower inner extension part 539*a* provided on the inner end of the lower coil 532, and electrically and mechanically connected thereto by a joining method such as welding.

The outer peripheral surface of the first upper inner extension part 538*a* abuts by way of an insulating cap 580 with an inner surface of an outer peripheral annular portion 571 of a fixing member 570 fixed to the armature shaft 510 by press-fitting. The inner peripheral end of the second upper coil end arm 534*b* is connected to a second lower inner extension portion 539*b* provided on the inner end of the second lower coil end arm 537*b*.

In this armature 540, the first and second upper coil end arms 534*a*, 534*b* at the axial ends of the upper coil bars 533 and the first and second lower coil end arms 537*a*, 537*b* at the axial ends of the lower coil bars 536 of the armature coils are disposed along the axial sides of the armature core and substantially perpendicularly with respect to the axial direction of the armature shaft 510.

The fixed poles 550 are fixed to the inside of the yoke 501 by means of a fixing sleeve disposed around the inner circumference of the fixed poles 550, and in this preferred embodiment permanent magnets are used; however, instead of permanent magnets, electromagnetic coils excited by electric current may alternatively be used.

As shown in FIG. 1, the magnet switch 600 is held by a brush holding member 800 and is disposed inside the end frame 700. The magnet switch 600 is fixed so that it is substantially perpendicular to the armature shaft 510.

The magnet switch 600 uses an electric current to drive a plunger 610 upward and cause two contacts (a lower movable contact and an upper movable contact) not shown in the drawing which move integrally with the plunger 610 to sequentially abut with a head part (not shown) of a terminal bolt 620 and a fixed contact (not shown). A battery cable (not shown) is connected to the terminal bolt 620.

Brushes 910 are electrically and mechanically fixed to the upper movable contact (not shown) by caulking or welding or the like. The upper movable contact (not shown) and the lower movable contact (not shown) are electrically connected by a resistor (not shown).

The brush holding member 800 has the function of a brush holder, the function of holding the magnet switch 600 and the function of holding a pulley 690 for guiding a cord-like member 680. The brush holding member 800 has a hole (not shown) through which the cord-like member 680 passes.

The brushes 910 are pressed axially against the first upper coil end arms 534*a* of the armature coils by brush springs 914 such as compression coil springs.

The brush holding member 800 engages the holding plate 810 to hold the same. This holding plate 810 is clamped between the yoke 501 and the end frame 700, and the inside of the cylindrical part 810*a* of the holding plate 810 of the brush holding member 800 holds the outer ring 1200*b* of the ball bearing 1200.

Next, the operation of the starter described above will be described.

When a current is passed through the magnet switch 600, the plunger 610 rises upward from a low position. Along with the rise of a plunger shaft, the upper movable contact (not shown) and the lower movable contact (not shown) rise and the rear end of the cord-like member 680 also rises. When the rear end of the cord-like member 680 rises, the front end of the cord-like member 680 is pulled downward and the pinion rotation restraining member 230 descends. At the point in time the restraining claw 231 engages with one of the corrugations 214 on the outer periphery of the pinion gear 210, the lower movable contact (not shown) abuts the head part (not shown) of the terminal bolt 620.

A battery voltage of the terminal bolt 620 is transmitted through the lower movable contact, the above-mentioned resistor, the upper movable contact and the above-mentioned lead wire (none of which are shown) to the upper brush 910. That is, a low voltage having passed through the resistor is transmitted to the armature coils through the upper brush 910.

With the lower brush 910 being connected to ground at all times through the holding plate 810 of the brush holding member 800, a current at a low voltage passes through the armature coils made up of the upper coils 531 and the lower coils 532. The armature coils produce a relatively weak magnetic force and this magnetic force acts (attraction or repulsion) on the magnetic force of the fixed poles 550 and the armature 540 rotates at low speed.

When the armature shaft 510 rotates, the planetary gears 320 of the planetary gear mechanism 300 are rotated by the sun gear 310 of the armature shaft 510. When the planetary gears 320 apply a torque to the internal gear 340 in the direction in which they drive the ring gear 100 by way of the planet carrier 330, by the operation of the overrunning clutch 350 the internal gear 340 is prevented from rotating. That is, because the internal gear 340 does not rotate, the rotation of the planetary gears 320 causes the planet carrier 330 to rotate at a reduced speed. When the planet carrier 330 rotates, the pinion gear 210 also tends to rotate. Because rotation of the pinion gear 210 is prevented by the pinion rotation restraining member 230, the pinion gear 210 moves forward along the helical spline 221 of the output shaft 220.

Along with the forward movement of the pinion gear 210, the shutter also moves forward and opens the opening of the housing 400. As a result of the forward movement of the pinion gear 210, the pinion gear 210 meshes completely with the ring gear 100 of the engine. Also, when the pinion gear 210 moves forward, the restraining claw 231 disengages from the corrugations 214 of the pinion gear 210 and after that the front end of the restraining claw 231 falls in behind the pinion gear 210.

When the pinion gear 210 has moved forward, the upper movable contact (not shown) abuts an abutment part of the fixed contact (not shown). When this happens, the battery voltage of the terminal bolt 620 is transmitted through the upper movable contact (not shown) and the lead wire (not shown) directly to the upper brush 910. That is, a high current flows through the armature coils made up of the upper coils 531 and the lower coils 532 and the armature coils produce a strong magnetic force and rotate the armature 540 at high speeds.

The rotation of the armature shaft 510 is reduced in speed and increased in torque by the planetary gear mechanism 300, and rotates the planet carrier 330. At this time, the pinion gear 210 rotates integrally with the planet carrier 330. Since the pinion gear 210 is meshing with the ring gear 100 of the engine, the pinion gear 210 rotationally drives the ring gear 100 and rotationally drives the output shaft of the engine.

Next, when the engine starts and the ring gear 100 rotates faster than the rotation of the pinion gear 210, due to the action of the helical spline, a retracting force acts on the pinion gear 210. However, the restraining claw 231 having fallen in behind the pinion gear 210 obstructs retraction of the pinion gear 210 prevents early disengagement of the pinion gear 210 so that the engine can be certainly started.

Also, when because the engine has started the ring gear 100 of the engine is rotated at a speed higher than the rotation of the pinion gear 210, the pinion gear 210 is rotationally driven by the rotation of the ring gear 100. When this happens, a torque transmitted from the ring gear 100 to the pinion gear 210 is transmitted through the planet carrier 330 to the pins 332 supporting the planetary gears 320. That is, the planetary gears 320 are driven by the planet carrier 330. When this happens, because a torque of the opposite direction to that of during engine starting acts on the internal gear 340, the over-running clutch 350 allows the rotation of the ring gear 100. That is, when a torque of the opposite direction to that of during engine starting acts on the internal gear 340, the rollers 353 of the overrunning clutch 350 disengage from the clutch inner 352 and rotation of the internal gear 340 becomes possible.

That is, after the engine starts, the relative rotation by which the ring gear 100 of the engine rotationally drives the pinion gear 210 is absorbed by the overrunning clutch 350, and the armature 540 is never rotationally driven by the engine.

In the preferred embodiment described above, the first upper coil end arms 534*a* forming the commutator extend in the direction of the armature shaft 510 substantially perpendicularly with respect to the armature shaft 510. Further, at least one of the first and second bearings 1100, 1200 supporting the armature shaft 510 of this armature 540 is a ball bearing and the inner ring 1110*a*, 1210*a* of this ball bearing is fixed to the armature shaft 510 and the outer ring 1100*b*, 1200*b* of the ball bearing is fixed to the cylindrical part 502*a* of the holding plate 502 or the cylindrical part 810*a* of the holding plate 810 of the brush holding member 800 and the armature 540 is pressed in the axial direction by the brush springs 914. The clearances of the first bearing 1100 and the second bearing 1200 in the form of ball bearings are closed and the armature 540 is prevented from moving in the axial direction and jumping of the brushes 910 in sliding contact with the first upper coil end arms 534*a* forming the commutator is suppressed and commutation deterioration can be suppressed. Therefore it is possible to provide a small and lightweight starter which can operate at high speeds. Also, it is possible to bear axial direction thrusts of the armature 540 by means of the ball bearings 1100, 1200.

The armature 540 is made up of the upper coil bars 533 and the lower coil bars 536 fitted in the slots 524 in the armature core 520 and the first lower coil end arms 537*a* having one end electrically connected to one end of the lower coil bars 536 and extending toward the armature shaft 510 substantially perpendicular with respect to the armature shaft 510 and disposed in the vicinity of an end face of the armature core 520 and the first upper coil end arms 534*a* with which the brushes 910 make sliding contact having one end electrically connected to one end of the upper coil bars 533 and extending toward the armature shaft 510 substantially perpendicular with respect to the armature shaft 510 and disposed in the vicinity of the first lower coil end arms 537*a* and the first bearing 1100 is disposed in the vicinity of the second upper coil end arms 534*b* and the second bearing 1200 is disposed in the vicinity of the first upper coil ends 534*a*. Therefore, the first bearing 1100 and the second bearing 1200 can be brought close to the armature 540 and the distance between the bearings can be made short and even if the armature 540 rotates at high speed the influence of armature imbalance is small.

There are provided the planetary gear mechanism 300 for reducing in speed the rotation of the armature 540 and the output shaft 220 to which rotation reduced in speed by this planetary gear mechanism 300 is transmitted and the sun gear 310 disposed at the end of the armature shaft 510 and forming a part of the planetary gear mechanism 300 and the first bearing 1100 is disposed between this sun gear 310 and the armature core 520. The distance between the bearings can be made shorter than in a conventional starter wherein the armature shaft is supported by a bearing disposed nearer its end than the armature shaft gear, i.e. the sun gear meshing with the planetary gears of the speed reduction mechanism.

The first bearing 1100 is supported by the holding plate 502 provided integrally with the yoke 501 having the fixed poles 550 on its inner circumference. Therefore, it is possible to dispose the first bearing 1100 in the vicinity of the armature core 520 and the effective rigidity of the armature rises and its resistance to vibration increases.

The second bearing 1200 is supported by the holding plate 810 of the brush holding member 800 holding the brushes 910 making sliding contact with the first upper coil end arms 534*a* of the armature 540, it is possible to bring the second bearing 1200 closer to the armature 540 and therefore it is possible to make the distance between the bearings shorter.

The armature shaft 510 has the armature core mounting portion 510*c* on which the armature core 520 is mounted and the first and second held parts 510*a*, 510*b* held by the first and second bearings 1100, 1200 and the external diameters of the armature core portion 510*c* and the first and second held parts 510*a*, 510*b* are substantially the same. Therefore, the rigidity of the held parts 510*a*, 510*b* increases and consequently when the armature 540 rotates at high speeds the armature shaft 510 is not bent by armature imbalance and its resistance to vibration increases.

Also, the armature 540 is pressed axially toward the pinion gear 210 by the brush springs 914 pressing the brushes 910 onto the first upper coil end arms 534*a* of the armature 540, the first and second bearings 1100, 1200 are easily pressed in the axial direction by way of the armature 540.

Figure 3:
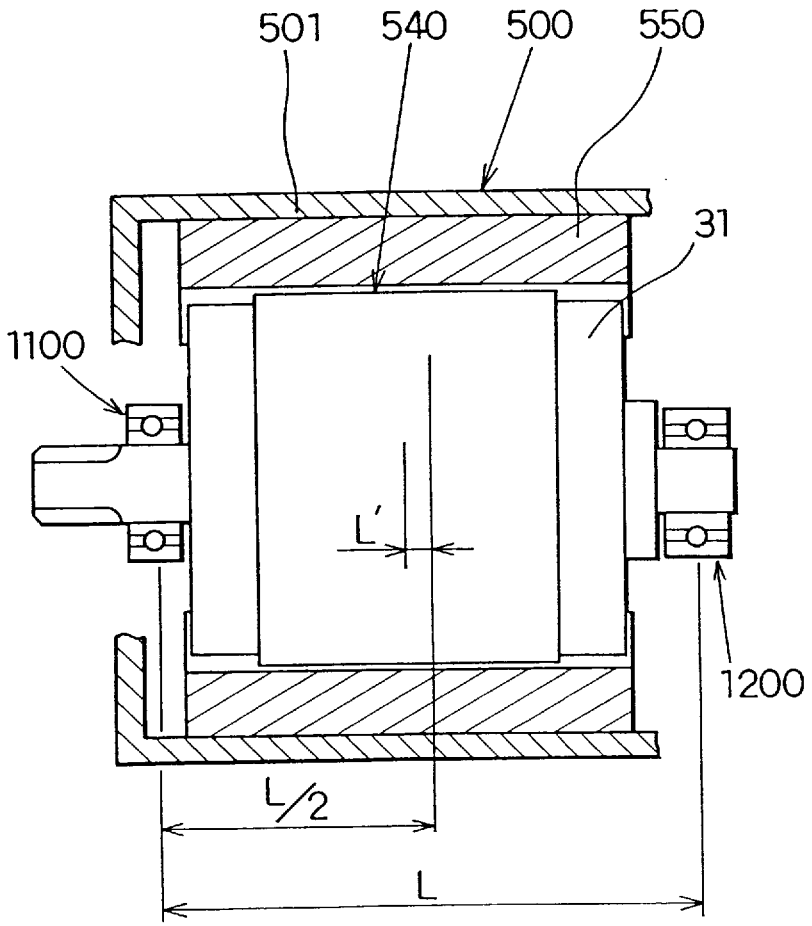
FIG. 3 is a schematic view showing the positions of a first bearing and a second bearing and the center of gravity of an armature in the starter shown in FIG. 1.

The positions of the first bearing 1100 and the second bearing 1200 and the center of gravity of the armature 540 in the preferred embodiment described above are shown in FIG. 3.

The length from the central position in the axial direction of the first bearing 1100 to the central position in the axial direction of the second bearing 1200 is denoted by L and the difference between the position a distance L/2 toward the second bearing 1200 from the axial central position of the first bearing 1100 and the position of the center of gravity of the armature 540 is denoted by L'. If it is supposed that a load P is applied at the center of gravity of the armature 540, the loads $P_1$, $P_2$ acting on the first and second bearings are expressed as follows.

$$P_1=P\cdot(L/2+L')/L$$

$$P_2=P\cdot(L/2-L')/L$$

From this expression, the difference between $P_1$ and $P_2$ is expressed as $P_1-P_2=2\cdot P\cdot L'/L$, and this relates to a difference between the lives or durability of the first and second bearings.

Here, if L'/L is set so that $L'/L \leqq 0.05$ W/P (W: the smaller rated load of the two bearings), the above-mentioned difference $P_1-P_2$ between $P_1$ and $P_2$ becomes smaller than 0.1 W and the load difference can be made less than 10% of the rated load of the bearings. In such an armature 540, compared with the conventional starter wherein a commutator made up of separate members with commutator segments made of resin or the like is disposed at one end of the armature core the axial length becomes shorter by an amount corresponding to this commutator being dispensed with and armature imbalance occurs less readily, and also by a position half-way between the axial direction center of the first bearing 1100 and the axial direction center of the second bearing 1200 and the position of the center of gravity of the armature 540 being made substantially the same, armature imbalance is further reduced and the starter becomes suited to high speed operation. Furthermore, because the difference between the loads acting on the two bearings can be made small the lives or durability of the bearings 1100, 1200 become approximately the same and it does not happen that just one of the bearings has a short life, and therefore stable durability can be ensured.

In the above-described embodiment, the ball bearings used as the first and the second bearings may be replaced by needle bearings.

Further, the present invention having been described should not be restricted to the preferred embodiment but may be modified in various ways without departing from the spirit and the scope of the invention.

What is claimed is:

1. A starter for an engine having a ring gear, comprising:

an armature having an armature shaft, an armature core fixed to the armature shaft and a commutator;

first and second bearings supporting rotatably opposite ends of the armature shaft, at least one of the first and the second bearings including a rolling bearing having an inner ring and an outer ring and receiving a radial load and a thrust load, the inner ring being fixed to the armature shaft;

first and second holding means respectively holding the first and the second bearings, at least one of the first and the second holding means fixing the outer ring thereto;

pressing means for pressing the armature axially;

a pinion driven by a rotation of the armature to mesh and rotate the ring gear of the engine; and a brush disposed axially toward the armature core, wherein the commutator has a commutator surface disposed at an axial side of the armature core substantially perpendicularly to the armature shaft, the commutator surface being in slidable contact with the brush, and the pressing means includes a brush spring pressing the brush against the commutator surface in the axial direction.

2. A starter according to claim 1, wherein:

the rolling bearing includes a ball bearing.

3. A starter according to claim 1, wherein the armature includes:

an upper coil bar and a lower coil bar fitted in each of a plurality of slots of the armature core;

lower coil end arms having respective one ends electrically connected to axial ends of the lower coil bar and extending toward the armature shaft substantially perpendicularly to the armature shaft, the lower coil end arms being disposed adjacent to and insulated from axial side faces of the armature core; and upper coil end arms having respective one ends electrically connected to axial ends of the upper coil bar and extending toward the armature shaft substantially perpendicularly to the armature shaft and having respective other ends connected to other ends of the lower coil end arms, the upper coil end arms being disposed adjacent to and insulated from the lower coil end arms, one of the upper coil end arms being in sliding contact with one of the end faces of the armature core, and wherein the first bearing is disposed at one axial side of the armature core and in the vicinity of the armature core at the other end of one upper coil end arm and the second bearing is disposed at other side of the armature core and in the vicinity of the armature core at the other end of the other upper coil end arm.

4. A starter according to claim 1, further comprising:

speed reducing means for reducing in speed the rotation of the armature;

an output shaft to which rotation reduced in speed by the speed reducing means is transmitted; and a gear forming a part of the speed reducing means and disposed on an axial end of the armature shaft, wherein the pinion is mounted on the output shaft to rotate the ring gear in response to the rotation of the output shaft and the first bearing is disposed between the gear and the armature core.

5. A starter according to claim 1, further comprising:

a yoke having field poles on an inner periphery thereof surrounding the armature, wherein the first holding means includes a holding plate formed integrally with the yoke.

6. A starter according to claim 1, wherein:

the second holding means includes a holding plate of a brush holder for holding a brush which contact slidably with a surface of the commutator disposed adjacent to the armature.

7. A starter according to claim 1, wherein:

the armature shaft has an armature core mounting part for mounting the armature core, and first and second held parts held by the first and the second bearings; and the armature shaft has substantially the same outer diameter throughout the armature core mounting part and the first and the second held parts.

8. A starter according to claim 1, wherein the armature includes:

an upper coil bar and a lower coil bar fitted in each of a plurality of slots of the armature core;

first and second lower coil end arms respectively electrically connected to axial ends of the lower coil bar and extending from the axial ends of the lower coil bar toward the armature shaft substantially perpendicularly to the armature shaft; and first and second upper coil end arms having respective one ends electrically connected to axial ends of the upper coil bar and extending toward the armature shaft substantially perpendicularly to the armature shaft and having respective other ends connected to other ends of the first and the second lower coil end arms, wherein a brush is disposed to slidably contact the first upper coil end arm at one axial side of the armature core, and wherein an axial center between an axial center of the first bearing and an axial center of the second bearing is substantially the same as a center of gravity of the armature.

9. A starter for an engine having a ring gear, comprising:

a yoke;

an armature disposed radially inside of the yoke and having an armature shaft, an armature core fixed to the armature shaft and a commutator;

first and second bearings supporting rotatably first and second axial end parts of the armature shaft respectively, each of the bearings having an inner ring and an outer ring and receiving a radial load and a thrust load, the inner ring being fixed to the armature shaft;

first and second holding means fixed to the yoke and respectively holding the outer ring of the first and the second bearings fixedly thereto;

speed reducing means disposed axially adjacent the armature core and the first rolling bearing for reducing in speed the rotation of the armature;

an output shaft to which rotation reduced in speed by the speed reducing means is transmitted;

a pinion mounted on the output shaft to mesh and rotate the ring gear of the engine;

a gear forming a part of the speed reducing means and disposed on an axial end of the first axial end part with the first bearing being positioned intermediate the gear and the armature core; and a spring disposed radially outside of the second bearing and pressing the armature axially in a direction toward the output shaft.

10. A starter according to claim 9, further comprising:

a brush disposed axially adjacent the commutator of the armature and biased to the commutator by the spring, wherein the commutator is disposed at an axial side of the armature core substantially perpendicularly to the armature shaft, the commutator surface being in slidable contact with the brush.

11. A starter according to claim 9, wherein the first holding means includes a holding plate disposed between the speed reducing means and the armature core and having a cylindrical part extending axially toward the armature core to hold the outer ring of the first bearing therein.

* * * * *